US006478370B1

(12) United States Patent
Reynolds

(10) Patent No.: US 6,478,370 B1
(45) Date of Patent: Nov. 12, 2002

(54) WAGON WHEEL BENCH

(75) Inventor: William H. Reynolds, Campbellsport, WI (US)

(73) Assignee: Wagon Wheels Unlimited, LLC, Campbellsport, WI (US)

( * ) Notice: Subject to any disclaimer, the term of this patent is extended or adjusted under 35 U.S.C. 154(b) by 0 days.

(21) Appl. No.: 09/842,412

(22) Filed: Apr. 27, 2001

(51) Int. Cl.[7] ..... A63G 9/10
(52) U.S. Cl. ..... 297/181; 297/232; 297/463.2
(58) Field of Search ..... 297/181, 217.1, 297/232, 463.1, 463.2; D6/371, 381

(56) References Cited

U.S. PATENT DOCUMENTS 270,023 A * 1/1883 Crandall ..... 297/181
2,710,659 A * 6/1955 Moederle ..... 297/217.1
5,971,483 A * 10/1999 Brenneman ..... 297/217.1
6,152,461 A * 11/2000 Dunks ..... 280/30

* cited by examiner

*Primary Examiner*—Peter R. Crown
(74) *Attorney, Agent, or Firm*—Donald Cayen

(57) ABSTRACT

A wagon wheel bench is comprised of a frame that includes a pair of wagon wheels with hubs that mount over the ends of a beam. A seat is secured to the beam. Opposite ends of the seat are recessed to receive the wagon wheel hubs such that the wagon wheel spokes are flush against and are attached to the seat ends. A back is notched at its ends to fit over the rim and one spoke of each wagon wheel. The wagon wheel bench is stationarily supported on the ground by support blocks that receive and are fastened to the wagon wheels. In a swing-type wagon wheel bench, the wagon wheels are hung by a pair of chains from an overhead support. Each chain has a first end attached to the overhead support, and a second end that is attached to a wagon wheel.

29 Claims, 5 Drawing Sheets

WAGON WHEEL BENCH

BACKGROUND OF THE INVENTION

1. Field of the Invention

This invention pertains to furniture, and more particularly to benches with different types of ground supports.

2. Description of the Prior Art

Furniture for sitting, both for indoor and outdoor use, is well known and in widespread use. For example, many different kinds of chairs and stools have been developed.

A particularly desirable type of sitting furniture for many situations is a bench. Benches are commercially available in numerous sizes and shapes, and they are especially suited for outdoor use. Benches usually have a relatively long seat such that more than one person can sit on them with comfort. The benches also normally have back rests, as well as stationary uprights that support the seat and back rest off the ground. A wide variety of ornamental designs have been incorporated into prior benches.

Some benches are not supported off the ground by stationary uprights. Rather, benches in the form of swings are supported by long ropes or chains that are hung from a support located above the bench. The supports are often part of a complete swing package.

Other benches are designed for back and forth movement by using relatively short swingable arms. Such benches, often called gliders, have supports that are stationary on the ground. First ends of the arms are pivotally connected to the bench at a low level on it. The other ends of the arms pivotally connect to the stationary supports at a higher level, but normally not higher than the back rest.

Despite the numerous kinds of benches in existence, there nevertheless is room for further developments to them.

SUMMARY OF THE INVENTION

In accordance with the present invention, a bench is provided that incorporates wagon wheels into a frame that supports the bench on the ground. This is accomplished by interposing the wagon wheels between a seat and ground-contacting frame members.

The seat can be as long as desired. The frame includes a long beam that underlies the seat and that protrudes past the seat ends. Hubs of the wagon wheels mount over both of the beam protruding ends. Accordingly, any weight on the seat is transferred through the beam to the wagon wheel hubs. The wagon wheel spokes are flush against and are fastened to the ends of the seat. For that purpose, the seat ends are recessed to receive the wagon wheel hubs. The seat recesses are covered with decorative face blocks.

The frame further comprises support blocks that support the wagon wheels off the ground. According to one aspect of the invention, a top surface of the support block has an arcuate groove of the same diameter as the wagon wheel rim. The wagon wheel is received in the support block groove and fastened to the support block. In that manner, the wagon wheel bench is stationarily supported on the ground by the support blocks and the rest of the frame.

It is an important feature of the invention that a back extends between and is joined to the two wagon wheels. For that purpose, the ends of the back are formed with notches. One notch at each end fits over a wagon wheel rim. Another notch fits over a wagon wheel spoke. The result is a very attractive but sturdy stationary bench that presents a rustic appearance.

Further in accordance with the present invention, the wagon wheel bench can be made as a swing. The swing-type wagon wheel bench comprises a seat and a beam with similar constructions as those of the stationary wagon wheel bench described above. The frame of the swing-type wagon wheel bench also includes a wagon wheel at each end of the seat. A back with notched ends is joined to the wagon wheels.

Instead of the stationary support blocks, however, the swing-type wagon wheel bench has a crossbeam above the seat. The crossbeam is supported above the ground by one or more posts. A pair of chains hang the wagon wheels from the crossbeam. First ends of the chains are attached to the crossbeam. Second ends of the chains are attached to the wagon wheels. In the preferred embodiment, the second ends of the chains are branched. Two branches are attached to the rims of the wagon wheels. An optional third branch is attached to the wagon wheel hubs. The wagon wheels are thus supported off the ground by the chains and crossbeam.

The method and apparatus of the invention, using a frame with wagon wheels for supporting a seat and back, thus combines versatility with attractive appearance. The wagon wheel bench is exceptionally sturdy, even though the frame can be chosen to provide either a stationary or a swing-type wagon wheel bench.

Other advantages, benefits, and features of the present invention will become apparent to those skilled in the art upon reading the detailed description of the invention.

DETAILED DESCRIPTION OF THE INVENTION

Figure 1:
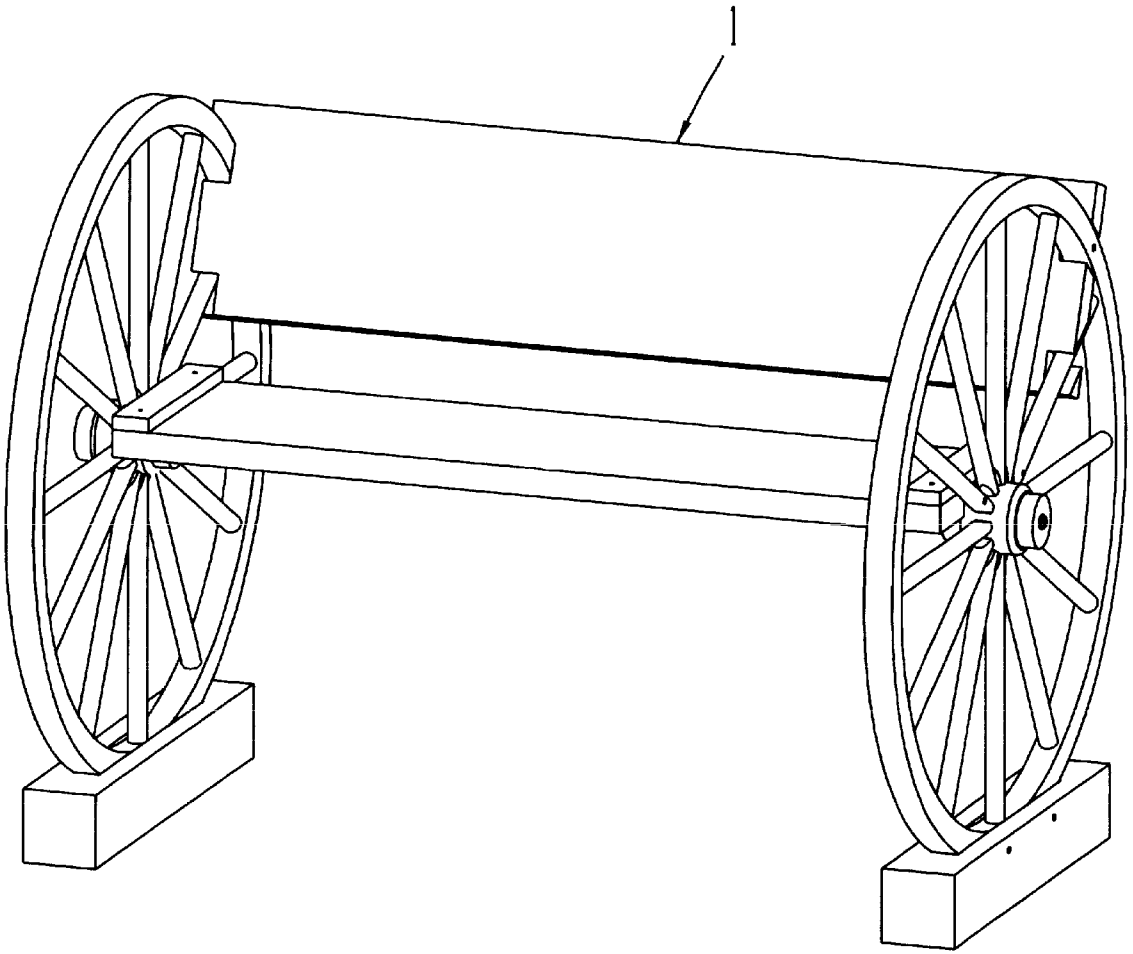
FIG. 1 is a perspective view of the wagon wheel bench of the present invention.
Figure 3:
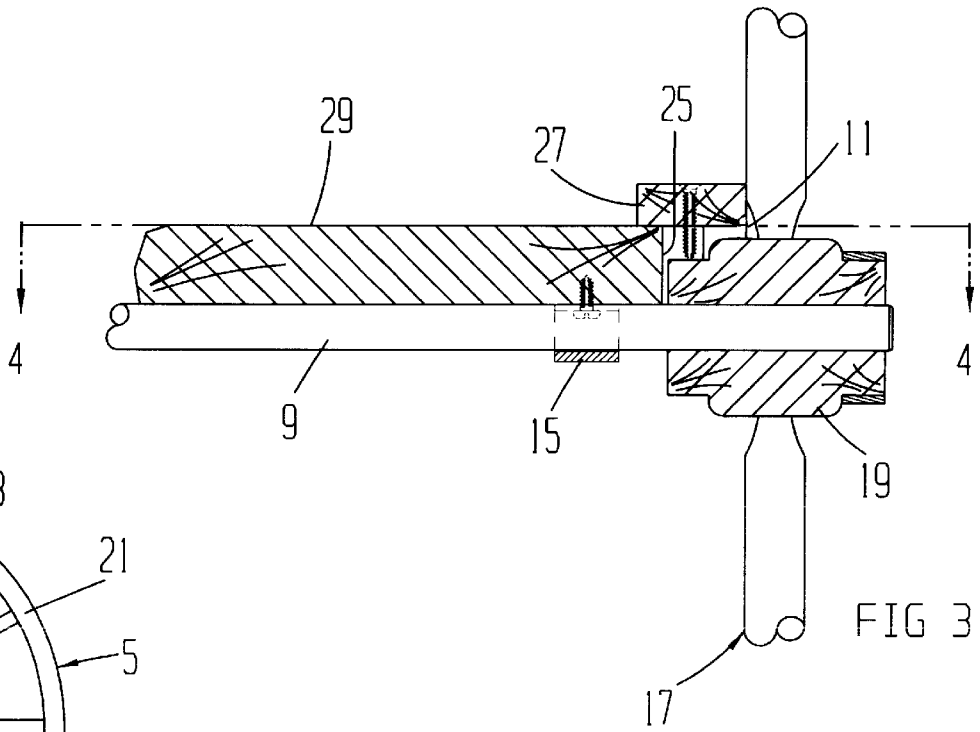
FIG. 3 is a partial cross-sectional view on an enlarged scale taken along line 3—3 of FIG. 2.
Figure 2:
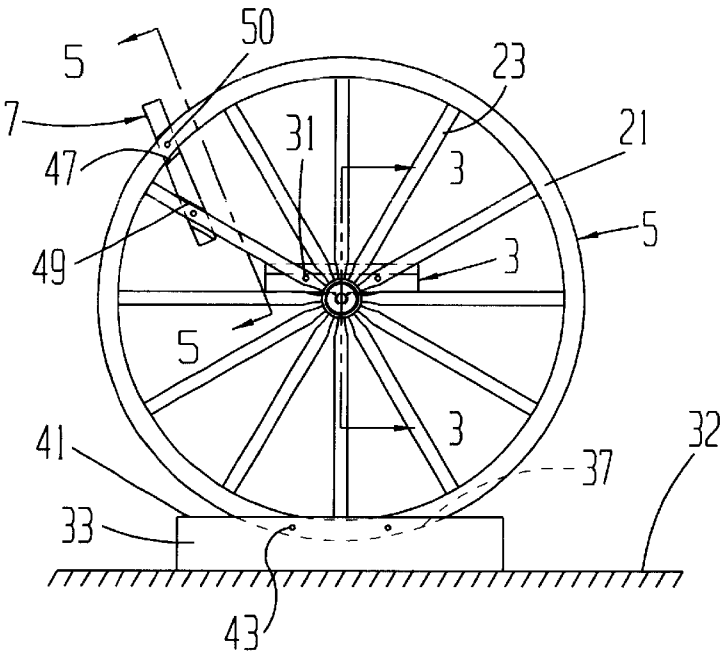
FIG. 2 is an end view of the invention.
Figure 4:
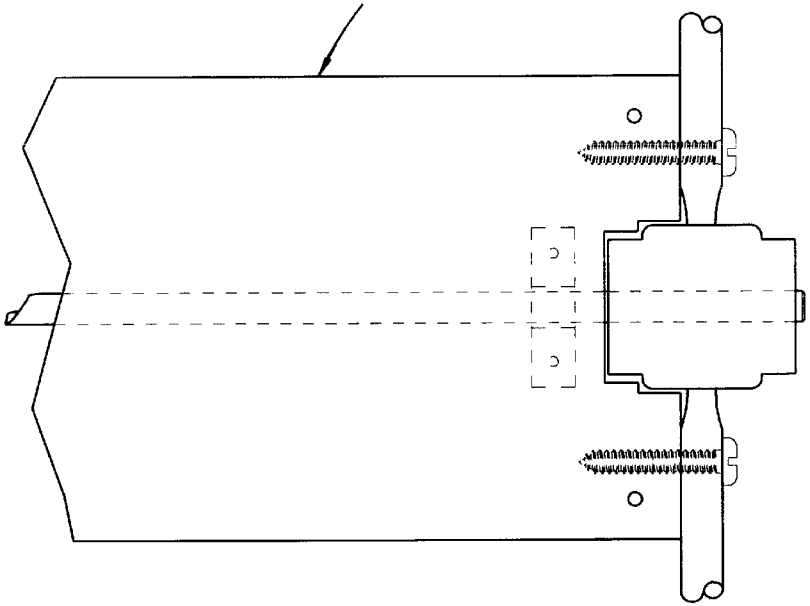
FIG. 4 is a partial cross-sectional view on a slightly reduced scale taken along line 4—4 of FIG. 2.
Figure 5:
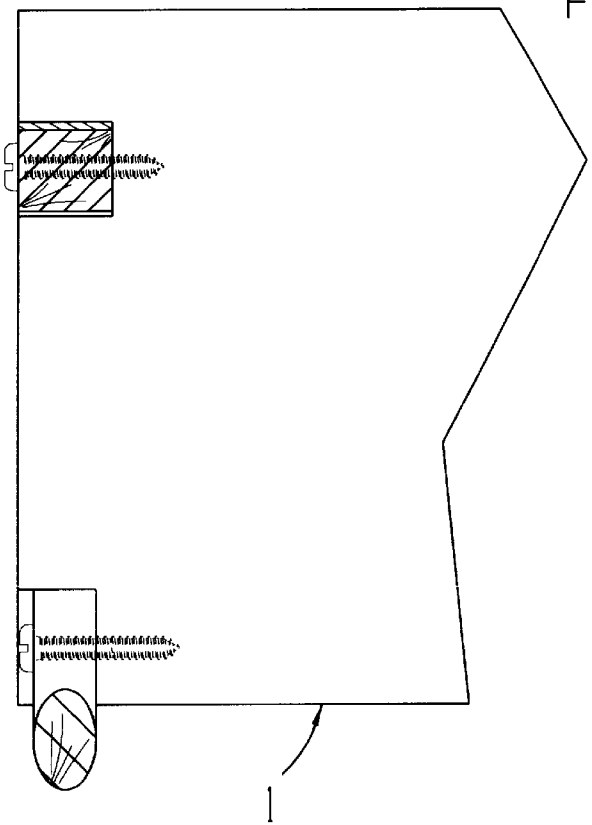
FIG. 5 is a cross-sectional view on an enlarged scale taken along line 5—5 of FIG. 3.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1–5, a wagon wheel bench 1 is illustrated that includes the present invention. The wagon wheel bench 1 is designed to be stationarily supported on the ground 32, and it comprises a seat 3, a frame 5, and a back 7. Preferably, the seat 3 is made as a wooden board, which may be pine. Although many sizes for the seat are acceptable, I prefer that the seat be approximately 49 inches long, approximately 11 inches wide, and approximately 1.50 inches thick.

In the illustrated construction, the frame 5 is comprised of a long beam 9 that underlies the full length of the seat 3 and that protrudes past the seat ends 11. In the preferred embodiment, the beam 11 is a cylindrical steel rod of approximately 0.88 inches diameter. The steel rod is secured to the seat underside 13 by two or more U-straps 15.

The frame 5 further comprises a pair of wagon wheels 17 each having a hub 19, a rim 21, and spokes 23. Each hub 19 has a bore that is sized to snugly mount over the steel rod 9. Hickory is a preferred material for the wagon wheels 17. Wagon wheels with a rim diameter of between approximately 30 inches and 36 inches work well.

It is a feature of the invention that the wagon wheel spokes 23 are flush against the seat ends 11 when the wagon wheels 17 are mounted over the steel rod 9. For that purpose, the seat ends are cut out with recesses 25. The recesses 25 are sized and shaped to receive one side of the wagon wheel hubs 19. In keeping with the pleasing aesthetics of the wagon wheel bench 1, a face block 27 is fastened to the top surface 29 of the seat 3 over each recess. The wagon wheels are attached to the seat ends 11 by screws or similar fasteners 31 that pass through two spokes 23.

To maintain the wagon wheel bench 1 stationarily in place on the ground 32, a pair of support blocks 33 are also part of the frame 5. The support blocks 33 may be made from wooden four by fours. Each support block has an arcuate groove with a bottom surface 37 having the same diameter as the wagon wheel rim 21. The groove has parallel side surfaces between the arcuate groove bottom surface 37 and the top side 41 of the support block. The wagon wheel rim is received in the support block groove. A pair of pins 43 are used to fasten the wagon wheel rim to the support block.

The back 7 extends between and is joined to the wagon wheels 17. Preferably, the back is a pine board approximately 11 inches wide and approximately 1.50 inches thick. To enhance the appearance and strength of the wagon wheel bench 1, the ends 45 of the back are formed with notches 47 and 49. The notches 47 are sized, shaped, and located to fit snugly over the wagon wheel rims 21. Similarly, the notches 49 fit snugly over a spoke 23 of each wagon wheel. Conventional fasteners 50 join the wagon wheel rims and spokes to the back. The design of the notches is such that any force on the back is transmitted to the wagon wheels through the back material around the notches rather than through the fasteners 50. The result is a very attractive, sturdy, and stable wagon wheel bench that is suitable for both indoor and outdoor use.

Figure 6:
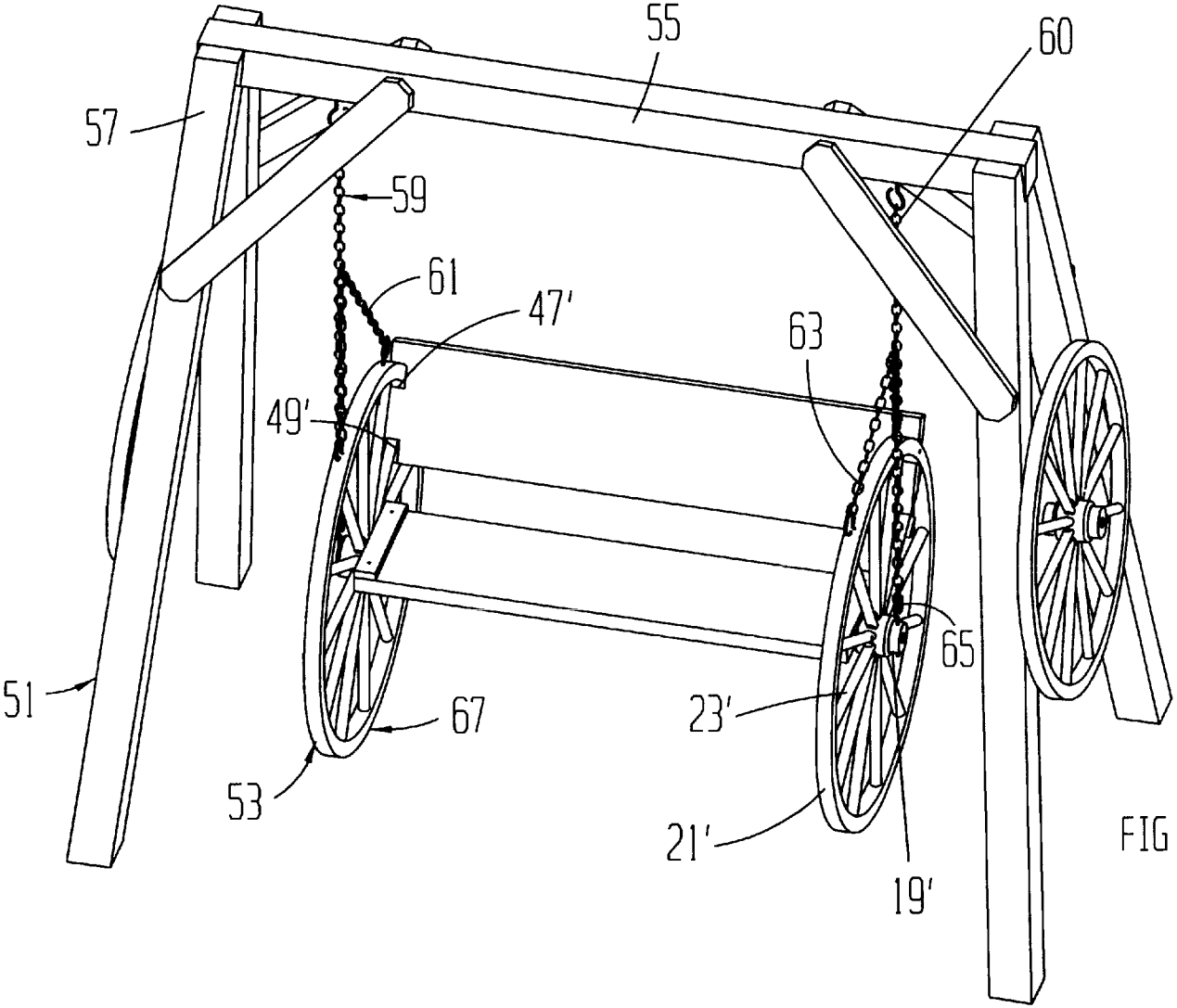
FIG. 6 is a perspective view of a modified embodiment of the invention.
Figure 8:
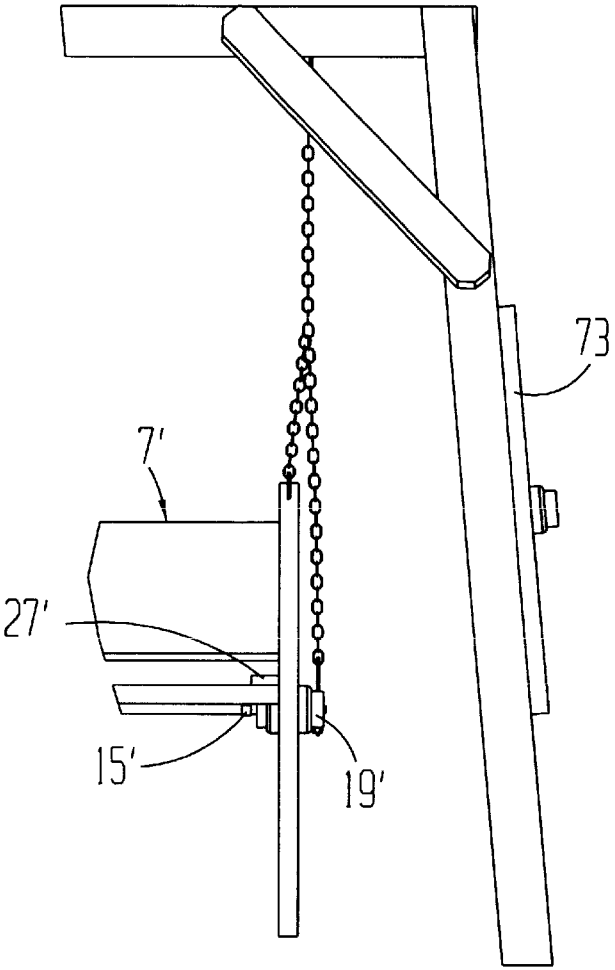
FIG. 8 a partial front view of the swing-type wagon wheel bench.
Figure 7:
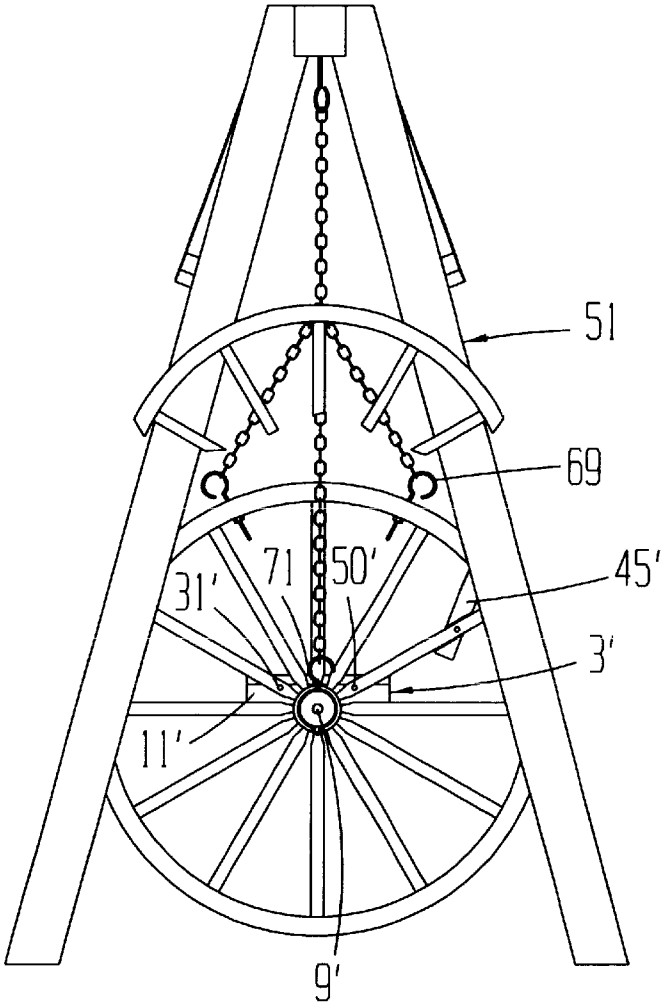
FIG. 7 is a broken end view of FIG. 6.

Further in accordance with the present invention, the wagon wheel bench frame can be constructed in a manner that enables the seat and back to swing over the ground 32. Turning to FIGS. 6–8, a swing-type wagon wheel bench 51 comprises a frame 53 having a crossbeam 55. The crossbeam 55 is supported above the ground in any suitable manner, such as by two pairs of posts 57. Near each end of the crossbeam hangs a chain 59. In the illustrated construction, the chains 59 each have a first end 60 attached to the crossbeam, and a second end with three branches 61, 63, and 65.

The frame 53 of the wagon wheel bench 51 further comprises a pair of wagon wheels 67, each having a hub 19', rim 21', and spokes 23'. The wagon wheel hubs 19' are mounted over opposite ends of a steel beam 9'. In turn, the steel beam 9' underlies and is secured to a seat 3' by U-shaped straps 15'. The seat 3' is cut out at its ends 11' with recesses (not shown) that receive the wagon wheel hubs 19'. The recesses 25' are covered with face blocks 27'. The seat ends 11' are attached to the wagon wheel spokes 23' by conventional fasteners 31'.

The wagon wheel bench 51 further has a back 7' with ends 45'. The back ends 45' are notched at reference numerals 47' and 49'. The back notches 47' fit snugly over the rims 21' of the two wagon wheels 67, and the notches 49' fit over one of the spokes 23' of each wagon wheel. The spokes 23' are joined to the back at the notches 49' by fasteners 50'.

To enable the seat 3' and back 7' to swing over the ground 32, the branches 61, 63, and 65 of each chain 59 are attached to a wagon wheel 67. Preferably, the branches 61 and 63 are attached to the wagon wheel rim 21', as by eyebolts and nuts 69. The chain branch 65 is attached to the wagon wheel hub 19' by another eyebolt and nut 71. In an alternate construction, the chain branches 65 are eliminated. In that situation, there is no attachment of the chains to the wagon wheel hubs 19'. To further enhance the decorative appearance of the swing-type wagon wheel bench 51, a wagon wheel 73 can be fastened over the frame posts 57. The completed wagon wheel bench 51 not only presents an attractive appearance, but it also provides much pleasure when used for swinging.

In summary, the results and advantages of sitting furniture can now be more fully realized. The wagon wheel bench provides both pleasing aesthetics and practicality. This desirable result comes from using the combined functions of the wagon wheels. The wagon wheels are part of the frame that supports the wagon wheel bench on the ground. Weight on the seat is transferred through the beam to the wagon wheel hubs. The recesses in the seat receive the wagon wheel hubs and enable the wagon wheel spokes to be flush against the seat ends. The decorative facing blocks cover the seat recesses. Because of the back notches that fit over the spokes and wagon wheel rim, virtually no force is transferred through the fasteners that join the back to the wagon wheel spokes. The support blocks 33 receive the wagon wheel rims to provide stable stationary support of the wagon wheel bench 1 on the ground or a building floor. On the other hand, the frame 53, including the crossbeam 55, posts 57, and chains 59, of the swing-type wagon wheel bench 51 provide both sturdiness and swinging motions to the swing type wagon wheel bench 51.

It will also be recognized that in addition to the superior performance and aesthetics of the wagon wheel bench, its construction is such as to cost little, if any, more than traditional stationary or swinging sitting furniture. Also, because it is made of a simple design and with rugged components, the wagon wheel bench gives long service life with little maintenance.

Thus, it is apparent that there has been provided, in accordance with the invention, a wagon wheel bench that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A wagon wheel bench comprising:

a. a seat having opposite ends;

b. a back having opposite ends; and c. a frame comprising:

i. a beam underlying the seat and protruding outwardly from the seat ends;

ii. a pair of wagon wheels each having a rim, a hub mounted to an end of the beam, and a plurality of spokes, at least one spoke of each wagon wheel being joined to an associated end of the back; and iii. means for supporting the wagon wheel bench on a selected surface.

2. The wagon wheel bench of claim 1 wherein the beam comprises a cylindrical rod secured to an underside of the seat and received on opposite ends thereof in the hubs of respective wagon wheels.

3. The wagon wheel bench of claim 1 wherein:

a. each end of the seat has a recess that receives the hub of the associated wagon wheel such that the spokes thereof are flush against the seat ends; and b. at least one wagon wheel spoke is attached to the associated seat end.

4. The wagon wheel bench of claim 3 further comprising a face block fastened to the seat over each recess.

5. The wagon wheel bench of claim 1 wherein:

a. each end of the back is formed with first and second notches;

b. the first notch at each back end fits over a wagon wheel rim; and c. the second notch at each back end fits over a selected wagon wheel spoke.

6. The wagon wheel bench of claim 1 wherein the means for supporting the wagon wheel bench comprises:

a. a support block in operative association with each wagon wheel, each support block having an arcuate groove that receives the associated wagon wheel rim; and b. means for fastening the support block to the associated wagon wheel, so that the wagon wheel bench is stably and stationarily supported on the selected surface.

7. The wagon wheel bench of claim 1 wherein the means for supporting the wagon wheel bench comprises:

a. a crossbeam;

b. means for supporting the crossbeam above the selected surface; and c. means for hanging the wagon wheels from the crossbeam in a manner that enables the seat and back to swing over the selected surface.

8. The wagon wheel bench of claim 7 wherein the means for hanging the wagon wheels comprises a pair of chains each having a first end attached to the crossbeam, and a second end with multiple branches, at least one first branch being attached to the rim of a wagon wheel, and a second branch being attached to the hub of the wagon wheel.

9. The wagon wheel bench of claim 7 wherein the means for hanging the wagon wheels comprises a pair of chains each having a first end attached to the crossbeam, and a second attached to a wagon wheel.

10. The wagon wheel bench of claim 7 wherein the means for hanging the wagon wheels comprises a pair of chains each having a first end attached to the crossbeam, and a second end attached to a wagon wheel rim.

11. The wagon wheel bench of claim 7 wherein the means for hanging the wagon wheel bench comprises a pair of chains each having a first end attached to the crossbeam, and a second end with multiple branches each attached to the rim of a wagon wheel.

12. Apparatus on which a person sits comprising:

a. a frame comprising:

i. a pair of wagon wheels each with a hub, a rim, and a plurality of spokes;

ii. a beam having opposite ends mounted in the hubs of the wagon wheels; and iii. means for supporting the wagon wheels off a selected surface;

b. a seat overlying the beam and secured thereto; and c. a back extending between and having opposite ends joined to the wagon wheels.

13. The apparatus of claim 12 wherein the seat is recessed at its ends to receive the hubs of the wagon wheels.

14. The apparatus of claim 13 further comprising a pair of face blocks fastened to the seat over the recesses in the seat.

15. The apparatus of claim 12 wherein:

a. the back has first notches in the ends thereof that fit over the rims of the wagon wheels; and b. the back has second notches in the ends thereof that fit over selected spokes of the wagon wheels.

16. The apparatus of claim 12 wherein the means for supporting the wagon wheels off a selected surface comprises a pair of support blocks each receiving and fastened to a wagon wheel, the support blocks being in contact with and stationarily supporting the wagon wheel bench on the selected surface.

17. The apparatus of claim 12 wherein the means for supporting the wagon wheels off a selected surface comprises:

a. first and second chains each having second ends that are attached to associated wagon wheels, and first ends; and b. means for hanging the chains first ends to support the wagon wheels off the selected surface.

18. The apparatus of claim 17 wherein each chain second end has multiple branches, at least one branch being attached to the associated wagon wheel rim, and at least one branch being attached to the associated wagon wheel hub.

19. The apparatus of claim 13 wherein at least one of the spokes of each wagon wheel is flush against and is attached to a seat end.

20. The apparatus of claim 17 wherein each chain second end has multiple branches attached to the associated wagon wheel rim.

21. The apparatus of claim 17 wherein each chain second end is attached to the rim of the associated wagon wheel.

22. A method of manufacturing a wagon wheel bench comprising the steps of:

a. providing a pair of wagon wheels each with a hub, spokes, and a rim;

b. mounting the wagon wheels over opposite ends of a beam;

c. securing a seat with opposite ends to the beam;

d. joining a back having opposite ends to the wagon wheels; and e. supporting the wagon wheels off a selected surface.

23. The method of claim 22 wherein the step of securing a seat to the beam comprises the steps of:

a. receiving the hubs of the wagon wheels in respective recesses in the seat ends; and b. attaching selected spokes of the wagon wheels to the ends of the seat.

24. The method of claim 22 wherein the step of joining a back to the wagon wheels comprises the steps of:

a. forming first and second notches in each end of the back;

b. fitting the first notches of the back over the rims of the wagon wheels; and c. fitting the second notches of the back over selected spokes of the wagon wheels.

25. The method of claim 22 wherein the step of supporting the wagon wheels off a selected surface comprises the steps of:

a. providing a pair of support blocks on the selected surface; and b. receiving the wagon wheels in and fastening them to respective support blocks, so that the support blocks stationarily support the wagon wheel bench on the selected surface.

26. The method of claim 22 wherein the step of supporting the wagon wheels off a selected surface comprises the steps of:

a. providing a support located above the wagon wheels;

b. attaching first ends of a pair of chains to the support; and c. attaching second ends of the pair of chains to the wagon wheels.

27. The method of claim 26 wherein the step of attaching second ends of the pair of chains to the wagon wheels comprises the steps of:

a. providing multiple branches on each chain second end;

b. attaching at least one branch of the chain second end to the wagon wheel rim; and c. attaching at least one branch of the chain second end to the wagon wheel hub.

28. The method of claim 26 wherein the step of attaching second ends of the pair of chains to the wagon wheels comprises the steps of:

a. providing multiple branches on each chain second end;

b. attaching two first branches on the chain second end to the wagon wheel rim; and c. attaching a second branch of the chain second end to the wagon wheel hub.

29. The method of claim 26 wherein the step of attaching second ends of the pair of chains to the wagon wheels comprises the step of attaching the second ends of the pair of chains to the wagon wheel rims.

* * * * *